United States Patent [19]

Mueller

[11] 4,065,908

[45] Jan. 3, 1978

[54] METHOD AND APPARATUS FOR SEALING TAMPER-INDICATING TABS TO A CONTAINER SIDEWALL

[75] Inventor: Martin Mueller, Wonderlake, Ill.

[73] Assignee: Owens-Illinois, Inc., Toledo, Ohio

[21] Appl. No.: 680,467

[22] Filed: Apr. 26, 1976

[51] Int. Cl.[2] ..... B65B 7/28; B65B 51/14; B65B 51/18; B65B 51/32

[52] U.S. Cl. ..... 53/15; 53/39; 53/128; 53/329

[58] Field of Search ..... 53/14, 15, 16, 17, 27, 53/39, 42, 45, 133, 329, 373, 379, 128

[56] References Cited

U.S. PATENT DOCUMENTS

| | | | |
|---|---|---|---|
| 2,748,005 | 5/1956 | Baier | 53/16 X |
| 3,243,934 | 4/1966 | Kinney | 53/39 |
| 3,338,027 | 8/1967 | Amberg et al. | 53/39 X |
| 3,555,764 | 1/1971 | Dowling | 53/133 X |
| 3,590,554 | 7/1971 | Carter | 53/329 X |
| 3,800,502 | 4/1974 | Vermeulen | 53/329 |
| 3,838,550 | 10/1974 | Mueller | 53/329 X |
| 3,906,703 | 9/1975 | Heisler | 53/42 |
| 3,955,006 | 5/1976 | Sokolsky et al. | 53/27 X |

*Primary Examiner*—Travis S. McGehee
*Assistant Examiner*—Horace M. Culver
*Attorney, Agent, or Firm*—David R. Birchall; Myron E. Click

[57] ABSTRACT

A container with a heat-securable tamper-indicating wax-coated closure sheet is disclosed herein, along with the methods and apparatus for making same. The container comprises a base with a sidewall extending upwardly from the periphery of the base and defining a substantially circular open top, or mouth. A square-shaped sheet of flexible closure material is disposed over the rim of the mouth of the container and is engaged between the container rim and a superposed container lid. Each of the four corners of the sheet extend beyond the periphery of the lid to form tabs which project downwardly alongside the container sidewall and are heat-sealingly secured thereto. The method and apparatus for securing the tabs to the container includes engaging the upper portion of the container with a plunger with a depending cylindrical flange for bearing against the projecting tabs of the sheet to urge them downwardly alongside the container sidewall at a temperature to heat-set them in that position. The container is moved on a conveyor between, and in contact with, a heated rail on one side and a cool sealing belt on the other side. The sealing belt engages the container to rotate the container about a vertical axis and roll the container along the heated rail to bring each tab sequentially into contact with the rail and the belt wherein the wax coating on the tabs is melted by the heated rail and subsequently pressed against the container sidewall by the belt to secure the corners of the sheet to the sidewall of the container.

27 Claims, 8 Drawing Figures

METHOD AND APPARATUS FOR SEALING TAMPER-INDICATING TABS TO A CONTAINER SIDEWALL

BACKGROUND OF THE INVENTION

This invention relates to a container having an opening, or mouth, covered with a flexible sheet of material, and an outer closure lid disposed above the flexible sheet. Such containers are generally used in the food packaging industry and embody various sizes, shapes and forms for packaging various food products, particularly of the flowable type.

Cottage cheese, butter, yogurt and similar foot-stuffs are commonly packaged and marketed in a container that is generally wax-coated or wax-impregnated paper or plastic. The container has a receptacle portion, consisting of a base and upwardly extending sidewall, and an outer closure lid which is pressed onto the sidewall top peripheral opening, or mouth, as snuggly as possible so as to minimize the entry of air or the escape of foodstuff from the closed container. Outer closure lids for such containers are either the plain disc-like lids which engage a peripherally extending bead located below the mouth rim on the container on the interior surface of the sidewalls, or so-called flush-type lids which fit across the opening of the container and have a depending skirt or snap-on engagement with an exterior portion of a beaded rim of the container, or so-called plug-type lids which project into the interior of the container adjacent the inner surface of the upwardly extending sidewall and engage the sidewall opening in snap-on relation.

Conventionally, with containers of this type, it is relatively easy for the consumer, or other person, to remove the outer lid as well as the underlying flexible sheet closure. Because of the relative ease with which the flexible sheet closure and the outer closure lid may be removed from the top of the container, innocent, or willful and malicious tampering with the container's internal contents is possible. After removing the outer lid closure, a potential consumer may lift up a portion of the flexible sheet closure from engagement with the top of the container. With such containers, it is possible to determine if the flexible sheet closure has been loosened from the top of the container, but only by lifting the outer closure lid from the container and performing a close inspection.

In known containers which include a flexible sheet inner closure underneath the lid, such as those disclosed in U.S. Pat. Nos. 3,301,464; 3,338,027 and 3,471,992, a thin film or sheet of flexible material is disposed across the opening of the top of the container and is in contact with, and supported by, the top peripheral surfaces of the rim of the container. With those containers employing plug-type lids, the plug-type lid presents a substantially vertical and peripherally-extending wall area, which will lie adjacent to the interior surface of the container sidewall immediately below the top edge of the rim of the container when the lid is placed thereon. This vertically disposed peripheral wall area of the plug-type lid will engage a portion of the flexible sheet film and press it against the interior surface of the sidewall of the container. In some conventional containers, the flexible sheet closure is heat-sealed to the portion of the container sidewall adjacent the vertical and peripherally-extending wall area of the plug-type lid. In other containers, the flexible sheet closure material may be heat-sealed across the upper surface of the rim of the container. Further, instead of heat-sealing, adhesive means can be employed.

While such double-seal containers have functioned generally satisfactorily, several problems have been encountered, both in manufacture and in ultimate use. With respect to manufacturing, in accordance with known techniques, it is necessary to cut the sheet closure to a relatively precise size and shape corresponding to the size and shape of the container lid and the mouth of the container. And, it is necessary to maintain the sheet in relatively precise registry with the lid and to secure the sheet to the lid prior to insertion of the lid into the mouth of the container. The strength of the attachment between the lid and sheet must be accurately controlled to prevent the lid from tearing the sheet when the lid is removed, as for example, to check the tamper-proof integrity of the container. And, since the sheet does conform in size and shape to the lid and mouth of the container, there are no readily graspable tabs to facilitate removal of the sheet when it is desired to get access to the contents of the container.

Owing to the possibility and ease of opening of the flexible sheet closure, as a result of inadvertent shipping and handling activities or as a result of innocent potential consumer curiosity or malicious tampering, it is desirable to be able to more easily determine if the flexible sheet closure has been opened. Further, it is desirable that a tamper-indicating construction be employed with such flexible sheet closures that will allow the closure to be used with many types of lids and containers now in use. Advantageously, such a tamper-indicating construction of a flexible sheet closure should be effective regardless of the manner of engagement of the closure with the upper rim of the container. That is, the tamper-indicating flexible sheet closure construction should be effective regardless of whether or not the flexible sheet closure is heat-sealed or adhesively secured to the top rim of the container or just non-sealingly supported thereon. Further, it is desirable that the tamper-indicating construction of the flexible sheet closure not require visual inspection through complicated, relatively more expensive, transparent windows in the outer closure lid when such outer closure lid is used. The taper-indicating flexible sheet closure construction should also work with a large variety of different types of flexible sheet materials that may be used.

SUMMARY OF THE INVENTION

The present invention embodies a new concept of a tamper-indicating sheet closure for a container having an opening on one end. The container contemplated by this invention comprises a base with a sidewall extending upwardly from the periphery of the base and defining a substantially circular open top, or mouth. In the preferred embodiment, the mouth of the container is circular and the sidewall is frusto-conical. The mouth is defined by an outwardly rolled beaded rim. Disposed across the rim is a sheet of flexible, film-like material which has a square-shape and wherein the length of each side of the square is at least equal to the outer diameter of the container rim. With some types of closures, such as the plug-type, the length of each side of the square of sheet closure material must be somewhat greater than the outer diameter of the container rim as will be explained hereinafter. The tamper-indicating closure sheet is placed across the container rim so that it covers all points on the container rim and so that the corners of the square sheet project beyond the outer periphery of the rim.

In the preferred embodiment, the tamper-indicating closure sheet is a thin plastic film which is wax-coated on at least one surface. The wax-coating is heat-sensitive and adapted for being heat-sealed to the side exterior surface of the sidewall of the container. In the preferred embodiment, an outer closure lid of the plug-type is engaged with the rim and upper portion of the container sidewall. The closure sheet is pressed between, and engaged by, the container rim on one surface of the sheet and by the outer closure lid on the other surface of the sheet. The corners of the closure sheet project outwardly and downwardly from the periphery of the outer closure lid and extend alongside the exterior surface of the sidewall of the container where they are secured by heat-seal affixation.

In the container of the present invention, the outer closure lid is not secured to the tamper-indicating closure sheet. The method and apparatus for associating the closure sheet with the lid, and for assembling the associated closure sheet and lid onto a filled receptacle is disclosed in detail in my commonly assigned, concurrently filed application Ser. No. 680,466 entitled "Method and Apparatus for Securing Tabs to Container," the disclosure of which is incorporated herein in its entirety by this reference. Thus, the outer closure lid can be relatively easily removed without tearing or pulling away the flexible closure sheet. If the outer closure is removed wholly or partially from the container, the container contents are still protected by the tamper-indicating closure sheet disposed across the container opening beneath the outer closure lid.

To gain access to the interior content of the container, it is required to remove, at least partially, the tamper-indicating closure sheet. The common method of removing the tamper-indicating closure sheet would be to grasp one of the corners that is heat-sealed to the exterior surface of the of the container sidewall and to pry it away, or pull it away, from the sidewall by breaking the heat-seal and then lifting up the closure sheet by pulling the corner further upwards above the top of the container. After this has been done, and the tamper-indicating closure sheet is subsequently lowered onto the rim of the container and the outer closure lid is subsequently engaged about the rim of the container over the closure sheet, then the loosened corner of the tamper-indicating closure sheet will not be sealed to the exterior wall of the container. This provides visual indication that the container has been opened. Note that the visual indication of tampering is thus determinable without removing the outer closure lid and without requiring the use of a transparent window, or other such device, in the outer closure lid.

In the preferred embodiment of the invention the container sidewall is circular in cross-section and larger in diameter at the upper end than at the lower end. Most preferably, the container is frusto-conically shaped. And, in such preferred embodiments it is desired that the lids be of the plug type described above, so that the dished, or recessed, central portion of the lid will serve to seat and retain the lower portion of a container stacked thereon for display in a retain establishment, such as a supermarket.

The method of securing tamper-indicating heat-securable closure sheet corners or tabs to the sidewall of the container is performed by moving a container upright along a process path and deflecting the projecting corners of the flexible tamper-indicating sheet to urge them downwardly alongside the sidewall of the container. In the preferred method, the projecting corners or tabs are simultaneously heated as they are downwardly deflected to create a heat-set that prevents the corners or tabs from springing upwardly again before the next step can be performed. The container is then moved between a pair of opposed first and second corner, or tab, sealing members. Heat is applied to the tabs with the first sealing member and the containers are rotated alongside the first sealing member so that all of the tabs are heated. As the container is thus rotated, the first and second sealing members press against the heated corners or tabs of the closure sheet to secure them to the sidewall of the container.

The apparatus for performing the above-described method consists generally of two stations and a conveyor for transporting the containers in an upright position from one station to the other station and through the stations. At the first station, a heated plunger is lowered over the outer closure lid on the top of the container to downwardly deflect the corners of the tamper-indicating sheet. Such plungers are associated with turret-type lid sealing machines, and each plunger includes a depending peripheral cylindrical skirt or flange that extends below the top of the rim of the container when the plunger is engaged with the lid on the container. In the preferred embodiment, the flange is in contact with the heated parts of the plunger for conducting heat from the plunger to the inner surface of the flange. The flange extends sufficiently downward so that when the plunger is engaged with the container lid, the flange deflects the projecting corners or tabs of the tamper-indicating closure sheet in a manner that will force them substantially downwardly alongside of the exterior surface of the container sidewall. The heat conducted through the flange effects a permanent heat-set in the closure sheet tabs to prevent them from springing upwardly after the container has left the station.

The containers with the thusly deflected tabs are then moved by a conveyor to the second and last station. The conveyor travels between a tab heating rail on one side and a moving, tab sealing belt on the other side. Both the tab heating rail and the tab sealing belt are elevated from the surface of the conveyor to a height adjacent the tabs of the closure sheet as they extend downwardly and alongside the container sidewall. In the preferred embodiment, the tab heating rail is mounted on, and connected to, an electrical resistance heating rod which conducts heat to the heating rail. The heating rail presents a flat surface parallel to the sidewall of the container and bears against the sidewall of the container as the container is moved along on the conveyor. On the opposite side of the conveyor, the tab sealing belt is rotating faster than the conveyor and engages the side of the container to roll the container along the tab heating rail whereby each tab is sequentially heated by the heating rail and subsequently pressed against the container sidewall by the tab sealing belt. In the preferred embodiment, the sealing belt is of a material that, when exposed to the ambient air temperature, maintains the belt surface at a temperature sufficiently low enough to cause the heated tab to cool and become "heat-sealed" to the sidewall of the container as it is pressed against the sidewall by the belt.

Numerous other advantages and features of the present invention will become readily apparent from the following detailed description of the invention and of one embodiment thereof, from the claims, and from the accompanying drawings in which each and every detail is fully and completely disclosed as part of the specification.

BRIEF DESCRIPTION OF THE DRAWINGS

In the accompanying drawings forming part of the specification, and in which like numerals are used to designate like parts throughout the same.

DESCRIPTION OF THE PREFERRED EMBODIMENT

Figure 1:
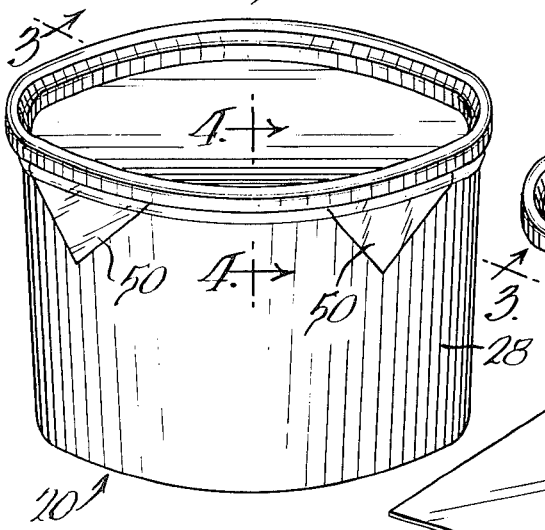
FIG. 1 is a perspective view of a filled and sealed container of this invention.

While this invention is susceptible of embodiment in many different forms, there is shown in the drawings, and will herein be described in detail, a preferred embodiment of the invention, with the understanding that the present disclosure is to be considered as an exemplification of the principles of the invention and is not intended to limit the invention to the embodiment illustrated. The scope of the invention will be pointed out in the appended claims.

For ease of description, the apparatus of this invention will be described in normal operating position and terms such as upper, lower, horizontal, etc. will be used with reference to this normal operating position. It will be understood, however, that apparatus of this invention may be manufactured, stored, transported and sold in orientation other than the normal operation position described.

Figure 2:
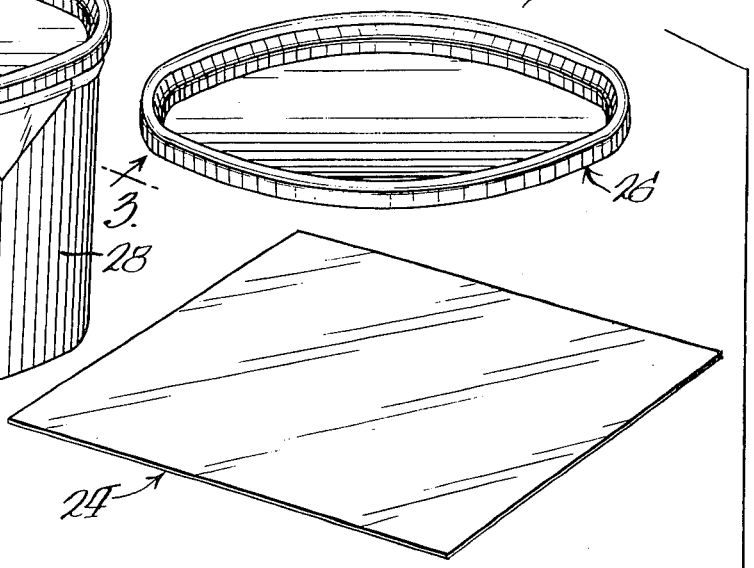
FIG. 2 is an exploded perspective view of the container of FIG. 1.

Referring first to FIG. 1 of the drawings, the container in accordance with the invention is generally indicated by reference numeral 20. As shown in FIG. 2, the container is comprised of three major elements: a lower receptacle portion 22, a flexible quadrilaterally-shaped closure sheet 24 disposed across a mouth of the container receptacle portion 22, and an outer closure means in the form of lid 26. The container of the present invention is similar to the containers described and claimed in the above-mentioned U.S. Patent to Amberg et al., U.S. Pat. No. 3,301,464, which is assigned to the assignee of the present invention, and reference may be made to that patent for background information relating to containers of the so-called "double seal" type.

Figure 3:
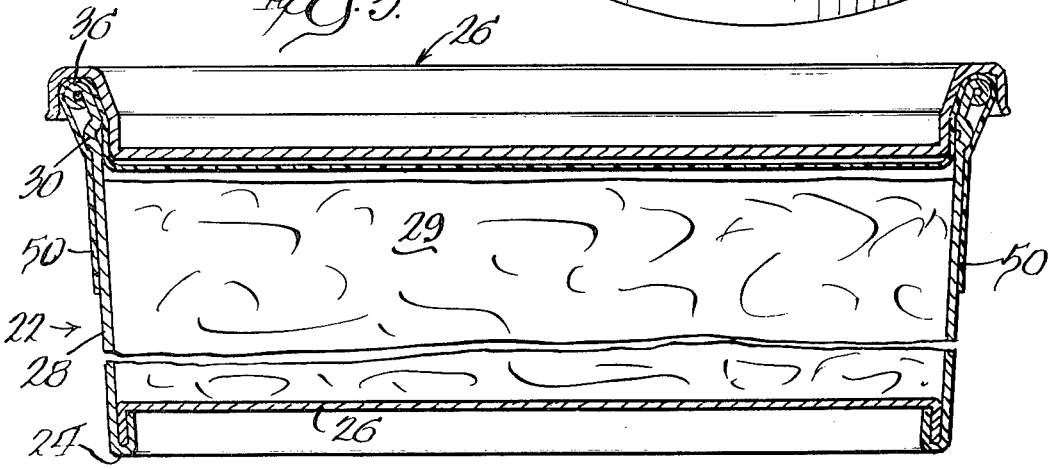
FIG. 3 is an enlarged cross-section view of the container taken along plane 3—3 of FIG. 1.

In the container of the present invention, the receptacle portion 22 is preferably made of wax-coated paper, although it will be understood that the receptacle portion might also be made of other materials. As illustrated in FIG. 3 of the drawings, the receptacle portion 22 is basically frusto-conically shaped and includes a circular base 24 depending downwardly from, and supporting, bottom portion 26. Sidewall 28 extends upwardly from the base 24 and defines an open top or mouth. The receptacle portion 22 is shown in FIG. 3 as containing a food-stuff such as a flowable liquid, generally indicated by reference numeral 29.

In the upper portion of sidewall 28 near the top edge of the sidewall 28 is a perpherally extending and outwardly projecting bead 30. Since bead 30 has a cross section that is curved with respect to the straight cross section of sidewall 28, more sidewall material is present per unit height of the sidewall in a shape that gives that portion of the sidewall a greater section modulus thereby strengthening the sidewall against buckling and/or bending. Bead 30 may also function to receive a projecting, mating, lid-locking bead from a plug-type lid (not shown) that could be used in place of the preferred lid 26 illustrated and described herein. Depending on the type of lid used and depending upon the thickness of sidewall 28 and upon the height of the container 20, bead 30 may be omitted.

Extending upwardly and outwardly flared, or conically tapered, from bead 30 is wall 32 which serves to guide and seat lid 26 in place on the container 20. The mouth of the receptacle portion 22 is defined by a conventional outwardly rolled beaded rim 34. Rim 34 provides additional rigidity and strengthens the sidewall 28 against buckling and bending. Rim 34 also serves as a support for flexible closure sheet 24 and lid 26.

Figure 4:
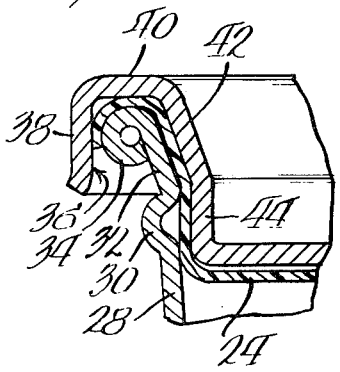
FIG. 4 is an enlarged fragmentary sectional view taken along plane 4—4 of FIG. 1.
Figure 4:
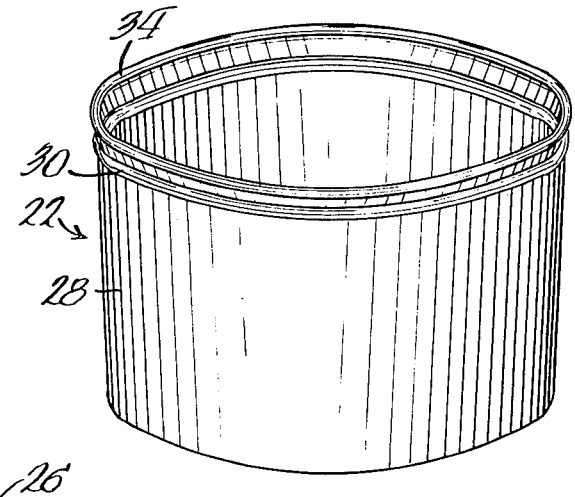

In the preferred embodiment, lid 26 is of the plug-type and is of one-piece construction. Lid 26 is generally disc-shaped and has an annular channel which opens downwardly about the periphery of the lid for receiving the rim 34 of the container 20. The annular channel is designated generally by reference numeral 36 in FIG. 4. The annular channel 36 has three walls: an outer depending peripheral skirt 38, a flat top wall 40, and a slanting inner wall 42. Extending from and below slanting inner wall 42 in a substantially vertical orientation is vertical wall 44. Inner wall 42 is outwardly flared or conically tapered to join top wall 40 with vertical inner wall 44.

A flexible closure sheet 24 is disposed across the mouth of receptacle portion 22 and contacts beaded rim 34 at all points on the periphery of the rim 34. Closure sheet 24 is generally centered over the mouth of the container and preferably has a square shape with the length of the sides of the square being slightly greater than the outer diameter of the rim. With the opening of the container completely covered by closure sheet 24, the lid 26, when in place on the container, engages the sheet 24 against the beaded rim 34 along the entire periphery of the mouth of the container. To this end, the inner mating surfaces of the walls 38, 40 and 42 of the annular channel 34 press against the upper surface of flexible closure sheet 24 and urge the sheet 24 into comformable contact engagement with container rim 34 and container wall 32.

As illustrated in FIG. 1, corners 50 of closure sheet 24 project from below lid 26 and extend downwardly adjacent sidewall 28. Each of the four corners thus forms a tamper-indicating pull tab, which may be conveniently manually grasped and pulled when it is desired to remove sheet 24 and obtain access to the contents of the container. The corners, or tabs 50, are secured to the sidewall 28 by an attachment means, joint, connection, or other affixation that permits the tabs to be peeled away from sidewall 28 and not become reattached. In the preferred embodiment, the corners or tabs 50 of the flexible sheet 24 are heat-securable, as by a heat-sealable wax coating, to the sidewall 28. In any case, the tabs 50 are each secured to the sidewall by suitable means. To open the container 20, it is necessary to first remove lid 26. Following removal of lid 26, one or more of the four tabs 50 must be removed from the secured engagement with the sidewall 28. Generally, this would be accomplished by a person putting the edge of a fingernail along the edge of a tab and prying the tab away from secured engagement with the sidewall 28. When enough of the tab 50 has been pried away, the pried away portion can be grasped between the thumb and index finger and pulled away from the sidewall 28 in an upward direction to pull the remaining portion of the tab 50 completely away from sidewall 28. By continued pulling on one of the tabs 50, the entire flexible closure sheet 24 can be lifted off of the container. Should one of the tabs 50 tear while it is being pulled, three other tabs are available for pulling.

In accordance with one significant feature of this invention, flexible closure sheet 24 is completely unattached or unsecured to lid 26. That is, in contrast to standard double-seal type containers, there is no adhesive or heat-sealable bond between the under surface of lid 26 and flexible closure sheet 24. Preferably, closure sheet 24 is coated on the one side facing away from the lid 26 with a heat-securable coating. The heat-securable coating serves two purposes: (1) closure sheet 24 can be heat-secured to the wall 32 of the inner surface of sidewall 28 and (2) the corners or tabs 50 can be heat-secured to the exterior surface of sidewall 28. Depending on the materials used in the construction of the sidewall and/or upon the coating thereon, and the type of heat-securable coating on the flexible closure sheet 24, the heat-secured attachment of the closure sheet 24 to the container may or may not be gas-tight or liquid-tight. The flexible closure sheet 24 need not be sealed at all to the wall 32 of the upper portion of the container sidewall 28. However, the corners or tabs 50 must be secured to the exterior surface of the sidewall 28 to function as tamper-indicating tabs as contemplated in this invention.

The flexible closure sheet can be made of a variety of materials, such as cellophane, plastic film, foil, or paper. The sheet can be transparent, translucent, or opaque, and can be adapted for receiving printed matter. Further, the flexible sheet 24 may be comprised of two or more laminated layers of different materials. While a wide variety of materials are contemplated for the closure sheet and container (as well as coatings thereon) it is important that the combination of materials and/or coatings have one characteristic, ie, the ability to be secured to one another only once, and not resealable so that once a tab has been lifted it cannot thereafter be reattached to the container sidewall. The flexible closure sheet 24 of this invention is preferably quadrilateral or square for ease of fabrication from rolls of sheet material whereby a quadrilateral or square sheet can be formed by simply making parallel cuts in the length of sheet material as it is pulled from a bulk roll.

The container with a tamper-indicating closure sheet of this invention thus provides a novel but simple means for determining if the container has been opened. It has been shown that it is very easy to determine if a container has been opened by merely observing the state of highly visible flexible sheet corners or tabs. The outer closure lid need not be removed from the container. Further, no complex and relatively expensive, window-type lid need be provided.

The present invention contemplates a novel apparatus for securing tamper-indicating closure sheet tabs to the sidewall of a container. To aid in understanding the apparatus of this invention, a short summary is here presented. In the preferred embodiment, the apparatus comprises two stations connected by appropriate conveyor means. In the first of these stations, a container is received with the flexible closure sheet in place over the mouth of the container and engaged thereon by a superposed lid. The flexible closure may or may not have been sealed or secured to the inner periphery of the container. For the purpose of this description, it is assumed that the flexible closure sheet employed is of the type which is contemplated in this invention, namely, one of quadrilateral shape and having corners of tabs projecting from the periphery of the lid. In the preferred embodiment of the apparatus of this invention, the container is received at the first station with the corners or tabs of the flexible sheet unsecured to the sidewall of the container. At this first station, the projecting corners or tabs of the flexible sheet are pushed downward adjacent the sidewall of the container. In addition, the flexible sheet is heat-sealed sealed to the inner periphery of the top of the container by a conventional closure sealing procedure. By appropriate conveyor means, the containers are then moved to the second and last station wherein the tabs are heated and then pressed against the container sidewall to form a heat-sealed attachment.

Figure 5:
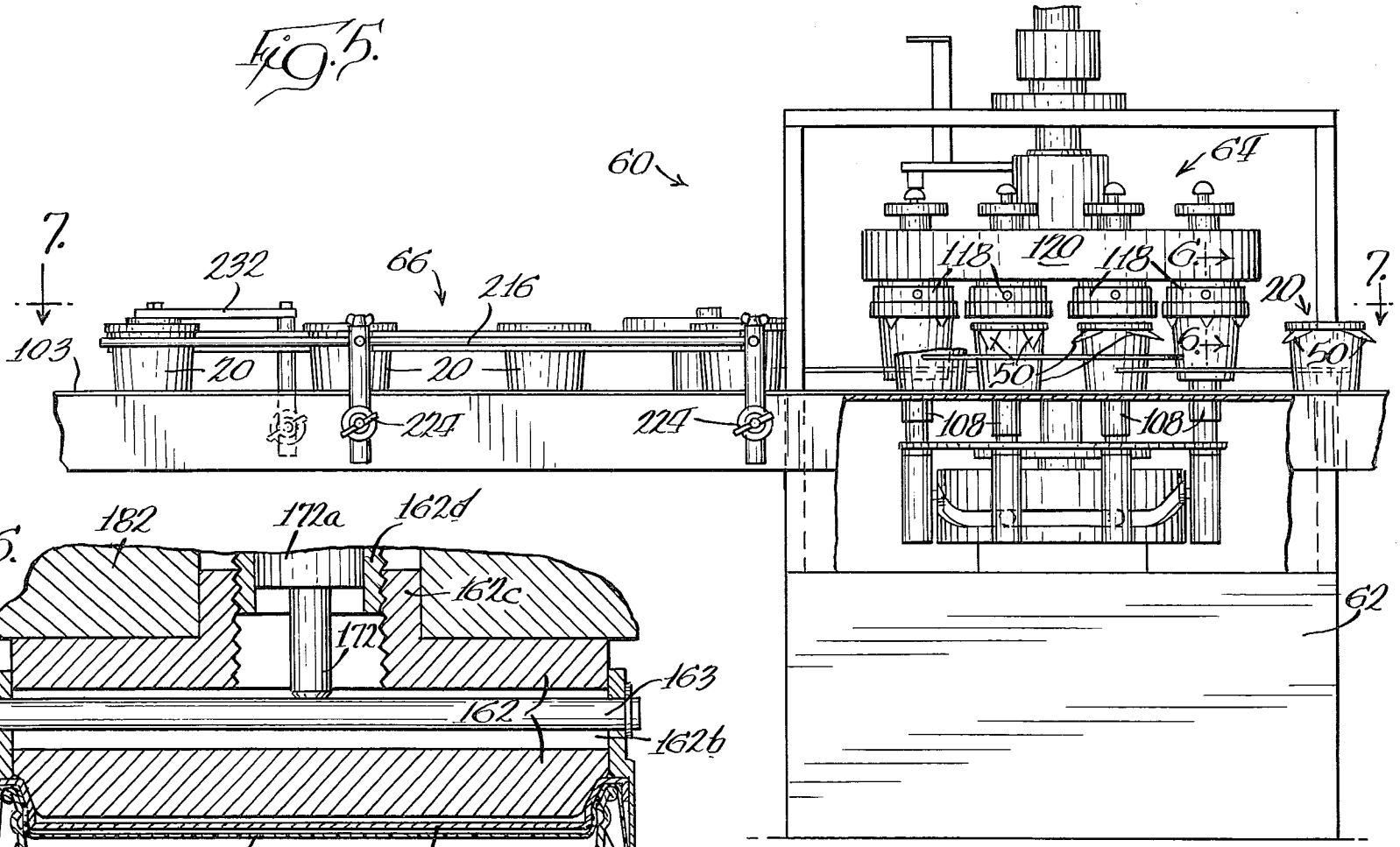
FIG. 5 is a partial side elevation view of a portion of the apparatus used to produce the container of this invention.
Figure 7:
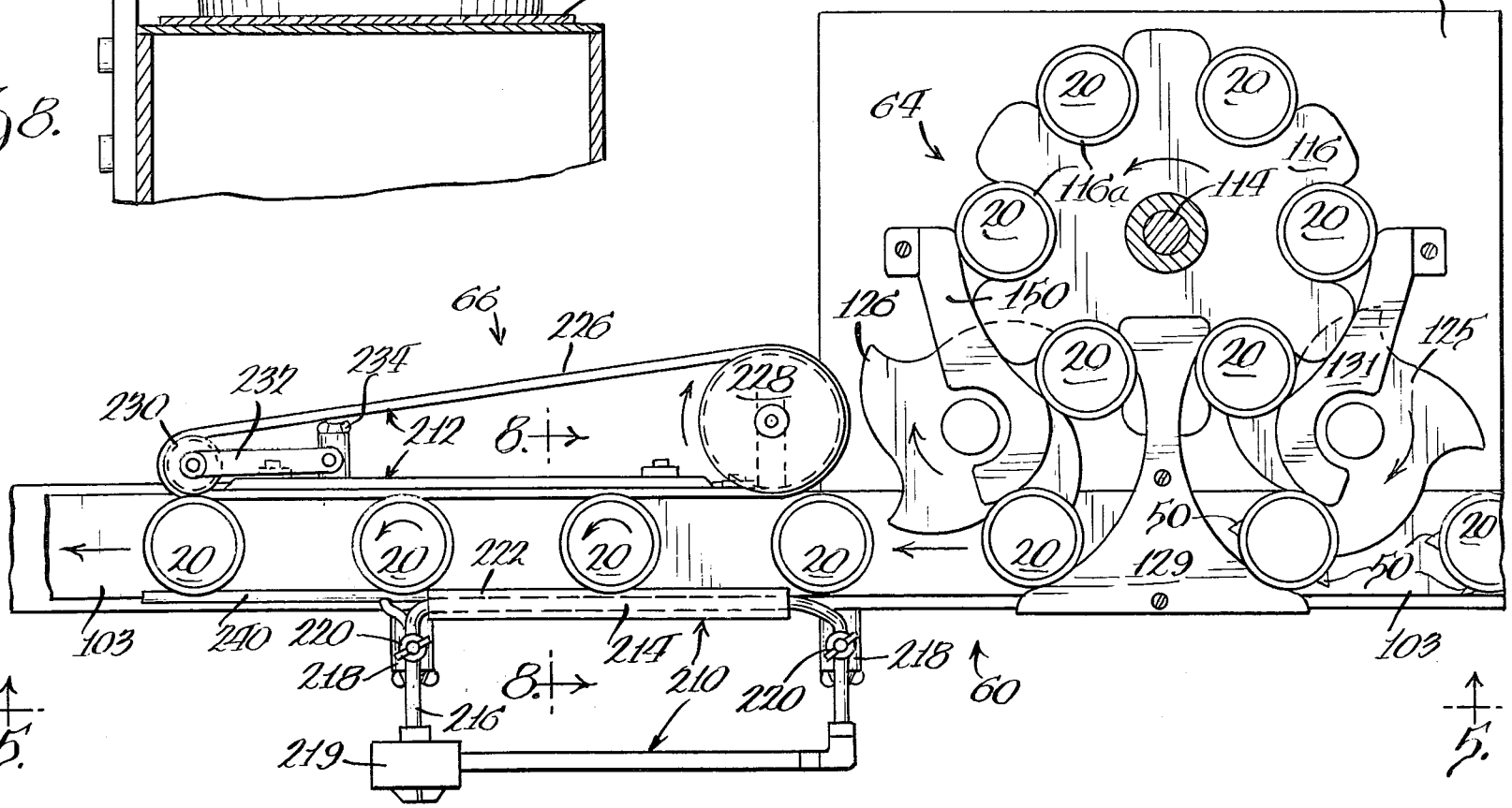
FIG. 7 is a plan view looking in the direction of plane 7—7 in FIG. 5.

Referring now to the drawings, the general overall arrangement of an apparatus in accordance with the invention is illustrated in FIGS. 5 and 7 and is generally designated by reference numeral 60. Referring particularly to FIG. 5, the apparatus 60 has a base frame 62 which houses certain conventional drive mechanisms which, though not fully illustrated or described, will be apparent to those having skill in the art and an understanding of the necessary functions of such drive mechanisms causing proper operation of the machine or apparatus in the manner as will be explained. The base frame 62 supports a first lid sealing and tab deflecting station 64 and a second station 66 for securing the tab 50 to the sidewall 28 of a container 20.

The first, or lid-sealing station 64 includes a turret-type sealing machine having a plurality of non-rotating, annularly spaced apart and heated sealing discs and matching bottom container support ram posts which revolve about the central axis of the machine. Details of this machine are described in U.S. Pat. No. 3,338,027 to Amberg et al., assigned to the assignee of the present application, and attention is directed thereto.

First station 64 receives the container 20 with the lids in place but with the flexible closure sheet 24 unsealed to the inner surface of the container rim. The containers 20 are received from a conveyor 103 mounted along the front edge of the machine 60. Mounted for rotation above the conveyor 103 are suitable rotating in-feed and out-feed star wheel apparatus 125 and 126. Suitable fixed guide apparatus 129, 130 and 131 are provided for the purpose of guiding containers 20 onto the respective container ram support posts 108 which are vertically movable and which revolve about the vertical central axis of the machine during operation. It will be further understood that the conveyor 103 is driven in the direction illustrated by the arrow in FIG. 7 by mechanisms (not illustrated) within the base frame 62, and that its speed is in timed relation with the speed of rotation of the in-feed and out-feed star wheels 125 and 126 for the purpose of moving the respective containers 20 smoothly into and out of the machine. Mounted for rotation on a fixed vertical shaft 114 is a container transport star wheel 116 which has a plurality of annularly spaced apart container receiving grooves 116*a* for positioning and carrying the capped containers 20 during the lid-sealing operation which is performed by the machine. The containers 20 are placed upon vertically movable container support posts 108 which, while revolving with the machine, elevate the containers 20 respectively into engagement with an associated sealing disc 118 which moves concurrently about the machine with the container in response to machine rotation.

Figure 6:
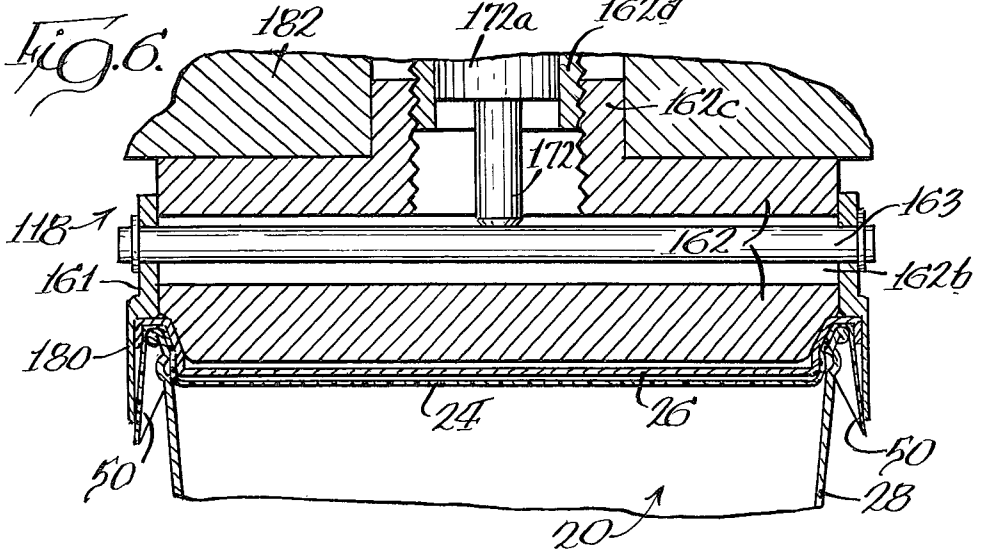
FIG. 6 is an enlarged fragmentary sectional view taken along plane 6—6 of FIG. 5.

FIG. 6 shows an enlarged cross-section view of a portion of a sealing disc 118 in engagement with a lid 26 on a container 20. The sealing disc 118 comprises a generally cylindrically shaped sealing disc element 162 which is made of aluminum and includes an upwardly projecting collar 162*c* having an internal thread for engaging the periphery of a cylinder 162*d*. A slot 162*b* extends through sealing disc element 162. Pin 163 is slidably received within the slot 162*b* for effecting vertical motion. The pin 163 is secured on either end to cylindrical lid hold-down element 161. Pin 163 is engaged at its mid-point with the lower end of a sealing head inner shaft 172 which has an enlarged portion 172*a* slidably disposed for vertical movement within cylinder 162*d*. The enlarged portion 172*a* of shaft 172 is biased with a spring (not shown) in a downward direction to urge pin 163 against the bottom of slot 162*d*. The spring bias pin connection effected by the spring biased shaft 172 acting upon pin 163 in slots 162*b*, functions to control the amount of force applied upon the lid 26 by sealing disc 162 by appropriate selection of, or presetting of, an adjustable spring.

As contemplated by the present invention, a novel tab guide means is provided to push the projecting container tabs 50 downwardly alongside the container. This is accomplished by a depending cylindrical peripheral side flange 180 to the lower portion of cylindrical lid hold-down element 161. Flange 180 is adapted for engaging the flexible film corners or tabs 50 and deflecting them to a downwardly extending position adjacent sidewall 28, as best seen in FIG. 6.

Disc element 162 is secured to support block 182 in intimate abutting contact. Associated with support block 182 is an electrical resistant heating mechanism (not shown) which heats support block 182. The heat from support block 182 is conducted into disc element 162. When a container lid is engaged by sealing disc 118, disc element 162 bears against the outer surface of lid 26 and presses lid 26 against flexible closure sheet 24 and the inner surface of sidewall 28. The heat from disc element 162 is conducted through lid 26 and acts upon the heat-sensitive coating (heat-sealable wax, for example) on the flexible closure sheet 24 to melt the coating. When the container lid 26 is removed from engagement with sealing disc 118, the lid and heat-sensitive coating cool. Since the flexible closure sheet 24 is maintained in intimate contact with the inner surface of sidewall 28 (i.e., wall 32 shown in FIG. 3) by the force exerted by the flexible plug-type lid 26, a satisfactory heat-sealed joint is achieved as the top of the container cools.

In operation, containers 20 enter the transport star wheel 116 from the right as shown in FIG. 7. At this point, the container tabs 50 are in an outwardly extending position with respect to the container sidewall 28. The bottom of the container 20 is engaged by support posts 108 and revolved about the machine in a counterclockwise direction. As the containers 20 are so revolved, sealing disc 118 engages the top of a container 20 as the support post 108 is raised forcing the container top into the disc 118. Depending flange 180 contacts the tabs 50 on the container 20 and deflects them downwards and adjacent to the container sidewall 28. As the heat is transmitted from sealing disc 162 to hold-down flange 161 and then to depending flange 180, the tabs 50 are heated and take on a heat-set orientation in the downwardly extending position adjacent the container sidewall 28. When the container 20 is lowered away from plunger 118, the tabs 50 remain in the downwardly extending position. The container 20 exits from the left side of the transport star wheel 126 as shown in FIG. 7, and proceeds along conveyor 103 to the second station 66 wherein the tamper-indicating tabs are secured to the container sidewall 28 as described hereinafter.

At the second station 66 is a first sealing means 210 for applying heat to the tabs 50 and a second sealing means 212 which cooperates with the first sealing means to press the heated tabs against the container sidewall to secure the tabs to the sidewall.

Figure 8:
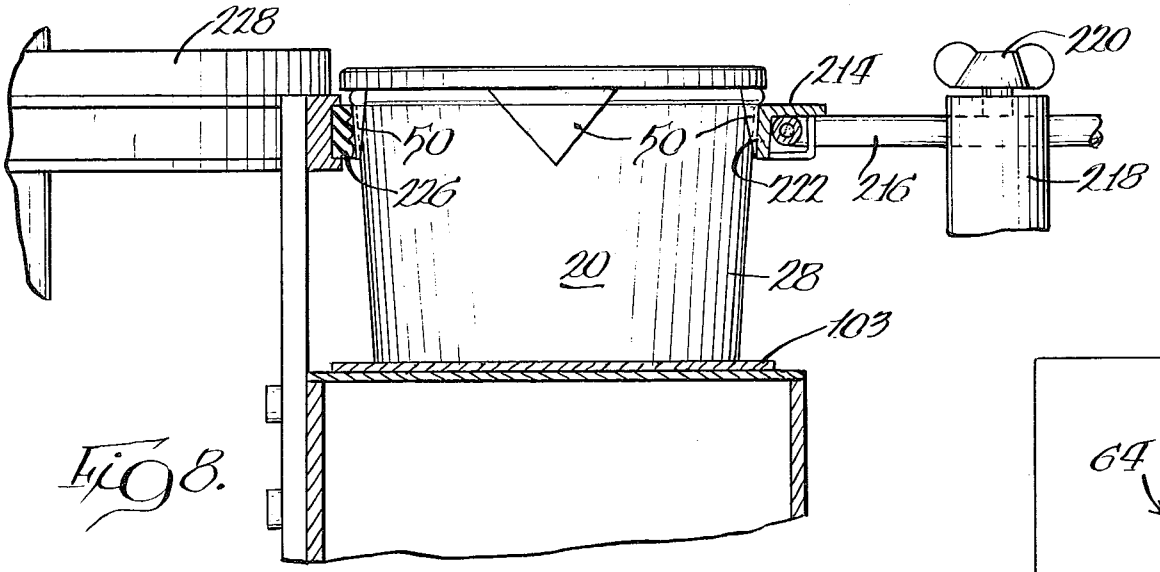
FIG. 8 is an enlarged fragmentary sectional view taken along plane 8—8 of FIG. 7.

Comprising the first sealing means 210 is a rail 214 having a right angle shape as seen in the cross section view of FIG. 8. Rail 214 is mounted on an electrical resistance heating rod 216. The current supplied to the electrical resistance heating rod 216 is supplied and controlled by appropriate control means 219 to heat the rail 214 to a temperature of around 400° F. The electrical resistance heating rod 216 is supported on each end of the rail 214 by support posts 218. The electrical resistance heating rod 216 and rail 214 are movable towards or away from conveyor 103 by means of a set screw adjustment 220 on each support post 218. The elevation of heating rail 214 can be adjusted to accommodate containers of different heights. To this end, support posts 218 are vertically adjustable by means of set screws 224 as illustrated in FIG. 5. As illustrated in FIGS. 7 and 8, rail 214 has a front flat face 222 which is adapted for disposition substantially parallel to, and in contact with, a container 20 supported by conveyor 103. The front flat face 222 of rail 214 contacts the sidewall 28 of the container 20 at the elevation wherein the flat face 222 has the capability of bearing against the downwardly deflected tabs 50 to thereby press the tabs against the sidewall 28 when the container 20 is moved on conveyor 103 adjacent the rail 214. Rail 214 is pivotally mounted about electrical resistance heating rod 216. This permits the rail 214 to rotate in response to contact by the container sidewall 28 and to be thereby urged to present the flat face 222 parallel to and in full line contact with, a portion of curved sidewall 28.

Rail 214, being supported in direct contact by electrical resistance heating rod 216, becomes heated by conduction of heat from rod 216. The front face 222 of rail 214 thus becomes hot and is capable of melting a wax coating on the tabs 50 or otherwise appropriately affecting a heat-sensitive coating on the tabs 50.

Opposite rail 214 and on the other side of conveyor 103 is the second sealing means 212 which comprises a movable sealing belt 226 for engaging one side of the container sidewall 28. Sealing belt 226 is rotated in the clockwise direction as viewed in FIG. 7 by a conventional drive wheel 228 and conventional idler wheel 230. The mechanism for rotating drive wheel 228 is a suitable rotary drive transfer mechanism connected to the main apparatus drive (not shown). The belt 226 is adjustable for horizontal movement towards and away from conveyor 103 by means of an appropriate pivoting lever arm 232 and set screw assembly 234. The end portion of the loop of belt 226 at the drive wheel 228 is disposed outwardly from conveyor 103 to permit unobstructed entry of containers 20 between belt 226 and rail 214. The horizontal placement of idler wheel 230 is adjusted to locate belt 226, in the region of the idler wheel, closer to the center of conveyor 103 than the portion of the belt at the drive wheel end. Thus, the belt 226 presents a somewhat angled lead-in for containers 20 as they pass between rail 214 and belt 226 and are progressively more tightly engaged therebetween. As the containers 20 are thus engaged, they are rotated about their vertical axis and are rolled along the rail 214 to bring each tab 50 sequentially into contact with rail 214 and with belt 226.

As a heated tab 50 is rotated out of contact with heating rail 214, the heated wax is in a melted condition. As the container 20 further rotates and the tab 50 is rotated into contact with belt 226 (which is at the same elevation as the tab 50), the tab 50 is compressed against the sidewall 28 of the container by belt 226. The tab 50 cools sufficiently, while being pressed by the belt to form a heat-sealed attachment to sidewall 28. Since the tab 50 must cool so that the melted wax will solidify to form a heat-sealed engagement, it is necessary that the belt 226 be sufficiently cool to promote such sealing. To this end, non-heat conductive materials are preferable for use in belt construction. If necessary, a convective cooling means, such as a fan (not shown) can be employed to cool the surface of the belt 226 as required. The speed of belt 226 is set to cause a container 20 to rotate at least once against rail 214 so that each tab is heated by the rail. To insure adequate application of sealing pressure upon the cooling tabs 50, belt 226 extends beyond the end of rail 214. Guide 240 is provided to furnish appropriate reaction force on the sidewall of containers 20 to maintain them on conveyor 103 downstream of the rail 214. Guide 240 extends from the end of rail 214 along the conveyor 103 and to, or slightly past, idler wheel 230. In the preferred arrangement, containers 20 rotate a total of 540°, 360° in contact with rail 214, and 180° in contact with guide 240.

The face of belt 226, as shown in FIG. 8, is preferably angled, or canted, to match the angle of the container sidewall 28. Appropriate adjustment features are desirable to allow alteration of this angle to handle containers with differently angled sidewalls. However, the use of an appropriately resilient material for belt 226, such as a urethane composition, enables sufficient pressure to be substantially evenly applied to the surface of the tab in contact with the belt even if the belt surface was not initially angled or canted. That is, a sufficiently resilient belt would deform under pressure from the container to the appropriately angled configuration.

From the foregoing, it will be observed that numerous variations and modifications may be effected without departing from the true spirit and scope of the novel concept of the invention. It is, of course, intended to cover by the appended claims, all such modifications as fall within the scope of the claims.

I claim:

1. The method of completing a double-seal tamper-indicating container having an inner sheet closure and an outer lid closure means, said method comprising: disposing a heat-securable tamper-indicating sheet over the top edge of a container sidewall, positioning said sheet so that tabs thereon project from the periphery of said container sidewall, applying an outer lid closure means over the top edge of the container sidewall and the marginal portion of said sheet, moving said container upright along a process path, deflecting said projecting tabs downwardly during movement of said container along said path to position the tabs alongside said sidewall while subjecting said tabs to a first application of heat whereby said tabs take on a heat-set orientation in a downwardly deflected position, moving said container between a pair of opposed first and second tab sealing members located adjacent said path, subjecting said tabs to a second application of heat with at least one of said sealing members, and pressing each of said heated tabs against said sidewall with both of said sealing members to secure said tabs against said sidewall.

2. A method as defined in claim 1, in which said step of moving said container upright along said process path includes supporting said container on its base on a moving conveyor belt.

3. A method as defined in claim 2, in which said sidewall is circular in cross section and said lid closure means is a generally circular lid, and in which said tab deflecting step includes raising the container partially into a cylindrical flange whereby the flange projects over the top of said container and around said sidewall to deflect said projecting tabs downwardly, alongside said sidewall.

4. A method as defined in claim 3, including the further step of heating said flange while in place over the top of said container to heat-set said tabs in the downwardly deflected position alongside said container sidewall.

5. A method as defined in claim 2, in which said first sealing member is a heated rail, and in which said step of subjecting said tabs to a second application of heat includes moving said containers in contact with said rail at the elevation wherein said tabs bear against said rail.

6. A method as defined in claim 5, in which said second sealing member is a sealing belt and in which said tab pressing step includes moving said containers in contact with said sealing belt at the elevation wherein said tabs bear against said sealing belt.

7. A method as defined in claim 5, including the further step of rotating said sealing belt against said container with a linear speed greater than that of said conveyor belt to thereby rotate said container about its vertical axis and bring each tab sequentially into contact with said heated rail and said sealing belt.

8. A method as defined in claim 7, including the further step of maintaining said sealing belt at a temperature sufficiently below said heated rail temperature to permit said tabs to cool in secured attachment to said container sidewall while in contact with said sealing belt.

9. The method of completing a double-seal tamper-indicating container having an inner sheet, an inner sheet closure, and an outer lid closure comprising: disposing a tamper-indicating square-shaped, wax-coated plastic sheet across the open top of the non-coated sidewall of a container, locating said sheet in the top edge of said sidewall so that portions of each of the corners of said sheet extend beyond the periphery of said sidewall, applying an outer lid closure means over said sheet and the top edge of the sidewall to engage the sheet between the closure means and the top edge of the sidewall, said corners of said sheet forming tabs projecting from the periphery of said closure means, moving said container upright along a process path, deflecting said projecting tabs downwardly to position them alongside said sidewall while subjecting said tabs to a first application of heat whereby said tabs take on a heat-set orientation in a downwardly deflected position, moving said container between a pair of first and second tab sealing members, rotating said container about its vertical axis, subjecting said tabs to a second application of heat with said first member to melt said wax coating, and pressing each of said tabs against said sidewall with said first and second members to secure said tabs to said sidewall.

10. A method as defined in claim 9, in which said step of moving said container upright along said process path includes supporting said container on its base on a moving conveyor belt.

11. A method as defined in claim 10, in which said sidewall is circular in cross section and said lid closure means is a generally circular lid and in which said tab deflecting step includes raising the container partially into a cylindrical flange whereby the flange projects over the top of said container and around said sidewall to deflect said projecting tabs downwardly, alongside said sidewall.

12. A method as defined in claim 11, including the further step of heating said flange while in place over the top of said container to heat-set said tabs in the downwardly deflected position alongside said container sidewall.

13. A method as defined in claim 10, in which said first sealing member is a heated rail, and in which said step of subjecting said tabs to a second application of heat includes moving said containers in contact with said rail at the elevation wherein said tabs bear against said rail.

14. A method as defined in claim 13, in which said second sealing member is a sealing belt and in which said step of pressing said tabs against said sidewall with said first and second members includes moving said containers in contact with said sealing belt at the elevation wherein said tabs bear against said sealing belt.

15. A method as defined in claim 14, including the further step of rotating said sealing belt against said container with a linear speed greater than that of said conveyor belt to thereby rotate said container about its vertical axis and bring each tab sequentially into contact with said heated rail and said sealing belt.

16. A method as defined in claim 15, including the further step of maintaining said sealing belt at a temperature sufficiently below said heated rail temperature to permit said wax-coated tabs to cool in secured attachment to said container sidewall while in contact with said sealing belt.

17. The method of completing a double-seal tamper-indicating container having an inner sheet closure and an outer lid closure means, said method comprising: disposing a heat-securable tamper-indicating sheet over the top edge of a container sidewall, positioning said sheet so that tabs thereon project from the periphery of said container sidewall, applying an outer lid closure means over the top edge of the container sidewall and the marginal portion of said sheet, deflecting said projecting tabs downwardly to position the tabs alongside said sidewall, while subjecting said tabs to a first application of heat whereby said tabs take on a heat-set orientation in a downwardly deflected position, subjecting each of said tabs to a second application of heat, and pressing each of said heated tabs against said sidewall with at least one tab sealing member to secure said tabs against said sidewall.

18. Apparatus for securing heat-securable tamper-indicating closure sheet tabs to the sidewall of a container having closure means disposed over the top edge of the sidewall, said tabs projecting from the periphery of said closure means, said apparatus comprising: conveyor means for moving said container in upright orientation along a process path, means on said process path for bearing against said projecting tabs to deflect them downwardly alongside said sidewall, means for subjecting said tabs to a first application of heat as they are deflected downwardly whereby said tabs take on a heat-set orientation in a downwardly deflected position, first sealing means for subjecting said tabs to a second application of heat, and second sealing means cooperating with said first sealing means for pressing each of the heated tabs against the container sidewall to secure the tabs to the sidewall.

19. Apparatus in accordance with claim 18, in which said means for bearing against said projecting tabs includes a disc having a cylindrical depending peripheral flange for extending below said closure means and adjacent said tabs for engaging said tabs beyond the periphery of said closure means.

20. Apparatus in accordance with claim 19, further comprising heater means for maintaining said depending flange at a temperature sufficient to heat-set said tabs in the downwardly deflected position alongside said container sidewall.

21. Apparatus in accordance with claim 18, in which said first sealing means comprises a rail on one side of said process path for engaging one side of said container, said rail having means for being heated along a portion of the length thereof.

22. Apparatus in accordance with claim 21, further comprising an electrical resistance-heated rod secured to said rail to conduct heat thereto.

23. Apparatus in accordance with claim 22, in which said rail has a flat face disposed substantially parallel to, and in contact with, said container sidewall when said container is in said process path.

24. Apparatus in accordance with claim 23, in which said rail is disposed at the same elevation with respect to said container as said second sealing means.

25. Apparatus in accordance with claim 23, including means for pivotally mounting said rail about an axis parallel to said process path for effecting placement of said rail face parallel to a container sidewall in response to engagement between said rail face and containers of varying shape.

26. Apparatus in accordance with claim 21, in which said second sealing means comprises a movable sealing belt means for engaging one side of said container on the side of said process path opposite said rail so that said containers are rolled along said rail while moving along the process path.

27. Apparatus in accordance with claim 26, including drive means for driving said sealing belt at a linear speed greater than said conveyor means sufficient to rotate said container about its vertical axis and bring each tab sequentially into contact with said heated rail and said sealing belt.

* * * * *